US008944210B2

(12) United States Patent
Sedlack, II

(10) Patent No.: US 8,944,210 B2
(45) Date of Patent: Feb. 3, 2015

(54) CENTER LADDER MEMBER APPARATUS AND METHOD

(75) Inventor: Russell L. Sedlack, II, Stuart, FL (US)

(73) Assignee: Vallery Industries, Inc., Stuart, FL (US)

( * ) Notice: Subject to any disclaimer, the term of this patent is extended or adjusted under 35 U.S.C. 154(b) by 238 days.

(21) Appl. No.: 11/752,867

(22) Filed: May 23, 2007

(65) Prior Publication Data

US 2007/0278039 A1 Dec. 6, 2007

Related U.S. Application Data

(60) Provisional application No. 60/803,017, filed on May 23, 2006.

(51) Int. Cl.

| | |
|---|---|
| ***E04G 3/00*** | (2006.01) |
| ***E06C 1/38*** | (2006.01) |
| ***B63B 27/14*** | (2006.01) |
| ***E06C 1/12*** | (2006.01) |

(52) U.S. Cl.

CPC ..... *E06C 1/381* (2013.01); *B63B 27/146* (2013.01); *E06C 1/125* (2013.01); *B63B 2027/141* (2013.01)

USPC ..... 182/91; 114/362

(58) Field of Classification Search

USPC ..... 114/362; 182/97, 91, 127, 195

See application file for complete search history.

(56) References Cited

U.S. PATENT DOCUMENTS

| | | | | |
|---|---|---|---|---|
| 3,291,255 | A * | 12/1966 | Glatfelter | 182/88 |
| 3,999,627 | A * | 12/1976 | Naka | 182/18 |
| 4,926,965 | A | 5/1990 | Fox | |
| 5,113,782 | A * | 5/1992 | McCarty | 114/362 |
| 5,427,049 | A * | 6/1995 | Mardikian | 114/362 |
| 5,697,470 | A * | 12/1997 | Carle | 182/88 |
| 5,752,580 | A * | 5/1998 | Jenkins, Jr. | 182/100 |
| 6,021,733 | A * | 2/2000 | Jaramillo, Sr. | 114/362 |
| 6,345,691 | B1 * | 2/2002 | Ruiz | 182/195 |
| 6,422,342 | B1 * | 7/2002 | Armstrong et al. | 182/127 |
| 6,578,510 | B1 * | 6/2003 | Scruggs et al. | 114/362 |
| 6,755,146 | B1 * | 6/2004 | Garelick et al. | 114/362 |
| 6,782,840 | B1 * | 8/2004 | Garelick et al. | 114/362 |
| 6,904,863 | B2 | 6/2005 | Mardikian et al. | |
| 6,938,573 | B1 * | 9/2005 | Garelick | 114/362 |
| 6,948,588 | B1 * | 9/2005 | Chustak | 182/97 |
| 7,025,174 | B1 * | 4/2006 | Hawley | 182/88 |
| 7,182,175 | B1 * | 2/2007 | Schmitt et al. | 182/88 |
| 2002/0166723 | A1 * | 11/2002 | Huber | 182/127 |
| 2004/0159279 | A1 * | 8/2004 | Garelick et al. | 114/362 |
| 2005/0016439 | A1 * | 1/2005 | Mardikian et al. | 114/362 |
| 2005/0204995 | A1 * | 9/2005 | Garelick et al. | 114/362 |
| 2005/0217935 | A1 * | 10/2005 | Chustak | 182/97 |
| 2006/0272567 | A1 * | 12/2006 | Scotti | 114/362 |
| 2006/0272895 | A1 * | 12/2006 | Lavoie | 182/127 |
| 2007/0240936 | A1 * | 10/2007 | Brookshire et al. | 182/127 |
| 2008/0202852 | A1 * | 8/2008 | Zsido | 182/129 |
| 2010/0229781 | A1 * | 9/2010 | Garelick | 114/362 |
| 2010/0230209 | A1 * | 9/2010 | Hughes et al. | 182/106 |

* cited by examiner

*Primary Examiner* — Katherine Mitchell
*Assistant Examiner* — Candace L Bradford
(74) *Attorney, Agent, or Firm* — Scott T. Griggs; Griggs Bergen LLP

(57) ABSTRACT

A ladder attachment having a base member slideably attached to lock member, a pivot mount pivotally attached to the lock member and a surface defining a lock port which is optimally configured to be orientated to slide upon the lock member when in a stored orientation such that when the base member and pivot mount is slideably repositioned with respect to the lock member, a ladder assembly which is attached to the pivot mount is in a stored orientation. The ladder assembly has an extended and retracted orientation.

20 Claims, 6 Drawing Sheets

CENTER LADDER MEMBER APPARATUS AND METHOD

RELATED APPLICATIONS

This application claims priority benefit of U.S. Ser. No. 60,803,017, filed May 23, 2006.

BACKGROUND

Ladder attachments in a particular ladder attachments to water vessels have been utilized in the prior art. Other forms of ladder attachments and ladder latch systems have been disclosed that can reposition to a degree into a retracted state. In general, it is desirable to have a ladder system on, for example, a boat where a ladder can be retracted and stored and further be deployed into an operating orientation with ease. There is a need for a combination of a ladder with a telescopic central member which further has a locking system to reposition the ladder into an operating orientation by repositioning a base member along a fixed locking member and further have the ladder portion be retracted in a telescopic manner and repositioned in a more vertically raised orientation.

In general, the disclosure relates to a ladder attachment, more particularly a ladder attachment for water vessels including boats and the like. In general, the device has an employed position and a retracted type position. Further, the device in one form has telescopically extending ladder components that in a preferred form do not rotate about a ladder axis.

SUMMARY OF THE DISCLOSURE

Disclosed herein is a ladder attachment configured to attach to a structure such as a perimeter region of a water vessel. The ladder attachment has a lock member which has a lateral component extending at least in part in a lateral direction. There is also a base member having a central channel with at least one laterally extending channel portion configured to receive and be slideably attached to the lock member.

The base member further has an attachment region and a pivot mount attached to the attachment portion. The pivot mount has an operational and stored orientation with respect to the base member. There is further a surface defining a lock port with the lock port being in substantial alignment with the channel portion of the base member when the pivot mount is in the stored orientation. Further in the stored orientation the lock port is operatively configured to have a portion of the lock member extend therethrough to maintain the pivot mount in the stored orientation.

Further provided is a ladder assembly having a first ladder section attached to the pivot mount. There is also in one form a second ladder section that is telescopically attached to the first ladder extension to have an extended orientation and a retracted orientation. In one form of attachment, the attachment region of the base portion is a pivot attachment with a pivot pin extending therethrough.

A main embodiment has the first and second ladder sections being comprised of a central post. In this form, the central post of the first and second ladder sections have a cross-sectional area which is noncircular to prevent rotation of the second ladder section with respect to the first ladder section. In one form the cross sectional area of the central post of the second ladder section is substantially oval and, for example, in another form the central post of the second ladder section is substantially rectangular.

Further disclosed herein is an embodiment where the first and second lateral components and the central channel of the base member and the lock port of the rotation mount each have first and second lateral portions orientated to have the first and second lateral components of the central channel extend therethrough when the lock member is in a stored orientation.

In another form the lock member has a first end region which is positioned adjacent to a flange portion of the perimeter portion of the water vessel where the distance between an inner surface of the flange portion and the first end region of the lock member is sufficient to allow an upper portion of the pivot mount to freely rotate therein when the base member is slideably positioned toward and engaging the first end region of the lock member. In this form, the ladder assembly in a stored orientation can further be configured to pass below a lower surface of the flange portion when the ladder attachment is in a stored orientation and slideably positioned in a first longitudinal direction along the lock member. In this form the ladder assembly can fit entirely within a vertical plane defined by a flange portion.

Of course other aspects of the disclosure are described herein by way of example of one mode of carrying out the protected concept.

DESCRIPTION OF THE PREFERRED EMBODIMENTS

Figure 1:
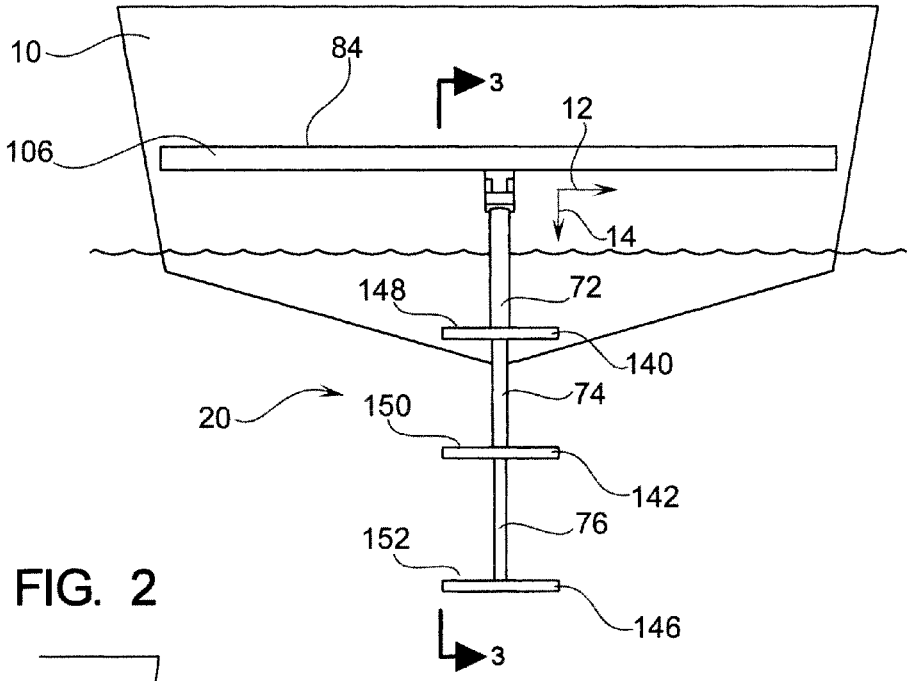
FIG. 1 shows a rear environment view of one implementation of the ladder attachment showing the rearward portion schematically of a water vessel.

In general, as shown in FIG. 1 there is a ladder attachment 20 comprising a base member 22, a ladder assembly 24 and a lock member 26. As shown in FIG. 1, the retractable ladder 20 is in the retracted orientation. The manner of maintaining this orientation will now be described after a detailed description of the components.

As shown in FIG. 1, there is an overall environment view where the ladder attachment 20 is attached to, for example, a perimeter region 106 of the water vessel 10 which in one form is a transom and or transom-like extension portion 84. In general, an axes system is defined where as shown in FIG. 1, the axis indicated at 12 is a transverse direction and the axis indicated at 14 is a vertical direction pointing downwardly. Orthogonal (or substantially orthogonal) to the axes 12 and 14 is a longitudinal direction where traveling toward the water vessel is a first longitudinal direction.

Figure 12:
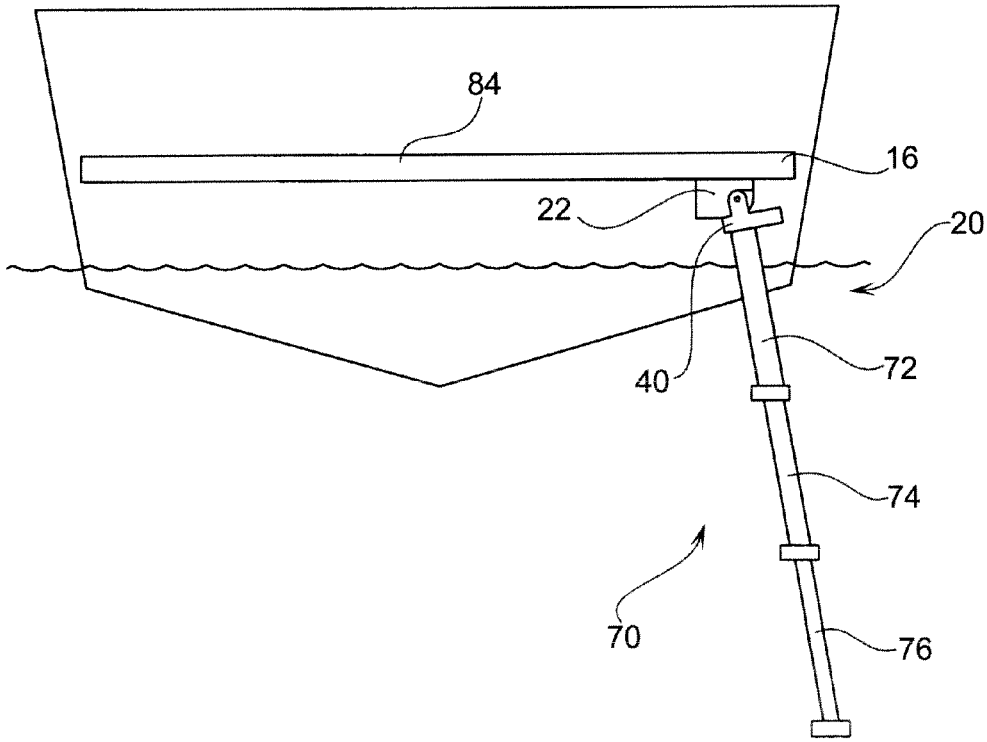
FIG. 12 shows another operating environment where the ladder attachment is positioned at a lateral orientation of a water vessel.
Figure 15:
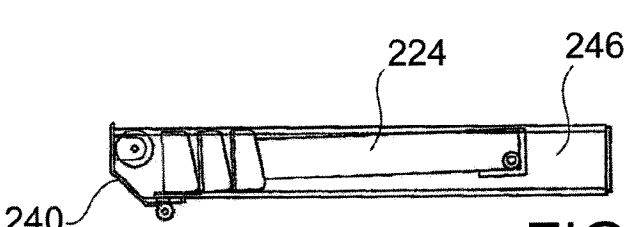
FIG. 15 shows a side view of the ladder mechanism in a stored orientation.

Referring ahead now to FIG. 12, there is shown another variation where the ladder attachment 20 can, for example, be attached to the lateral portion 16 of the transom-like member 84. Of course, it can be appreciated that the ladder attachment 20 can be attached in a variety of methods and to a variety of operating environments.

Figures 3, 4:
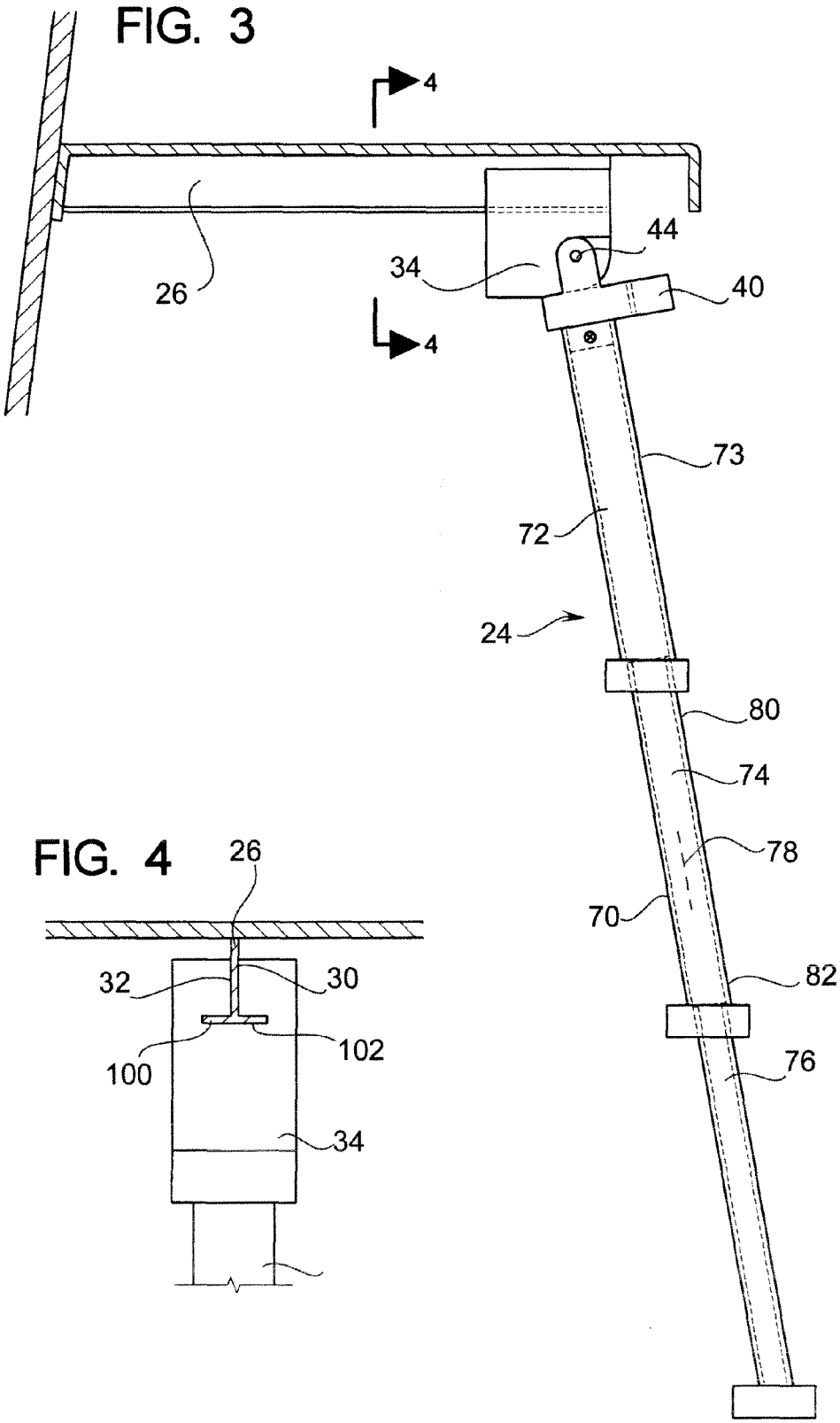
FIG. 3 shows a partial sectional view taken at line 3-3 of FIG. 1 showing the ladder attachment in the operational orientation with the ladder assembly extended.
FIG. 4 is taken along the line 4-4 of FIG. 3 showing the base member along a longitudinal direction.
Figure 5:
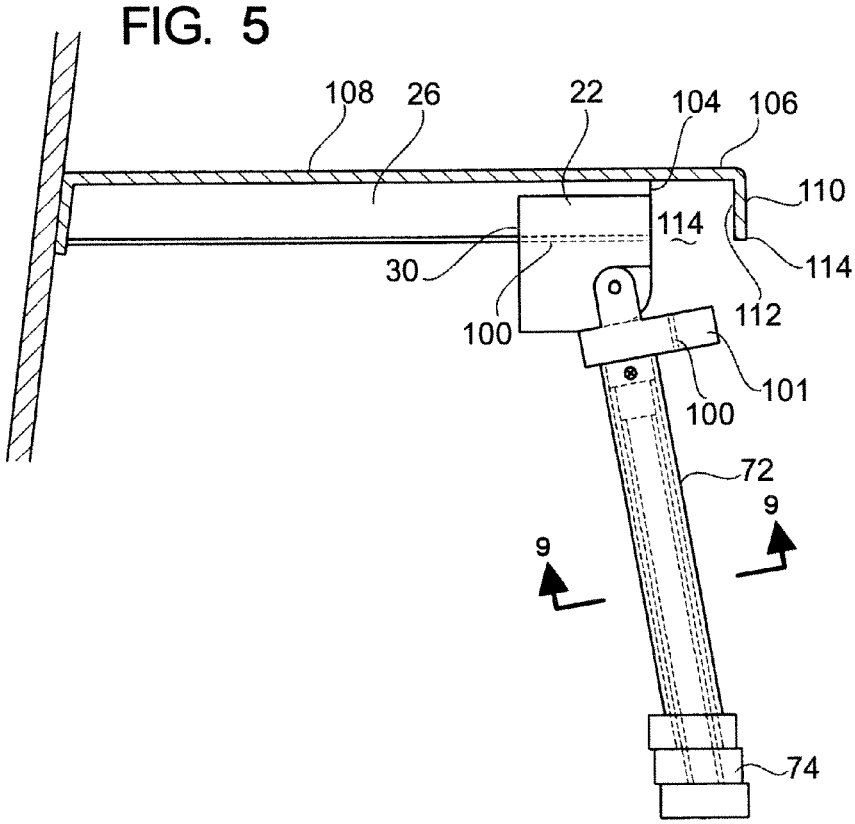
FIG. 5 is another cross sectional view of similar to FIG. 3 where the ladder assembly is in a retracted orientation.

As shown in FIG. 5, the base member 22 in one form is a block-like structure having a surface 30 that defines an access port 32 that allows the locking member 26 to pass therethrough (see FIG. 4). The base member 22 has a pivot attachment portion 34 which pivotally attaches to the ladder assembly 24 described herein. The base member 22 can freely slide through the locking member 26 through the access port 32. The ladder assembly 24 comprises a pivot mount 40 having a lock portion 42 and a pivot attachment region 44. The pivot attachment region 44 coincides in location with the pivot attachment region 34 of the base number 22. The base portion is slideably attached to the locking member 26 where the locking member in one form is rigidly attached to the transom region of a water vessel.

Figure 6:
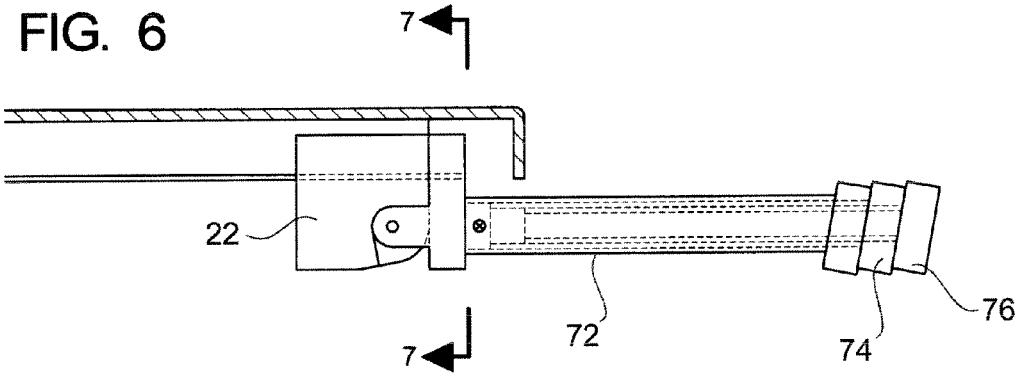
FIG. 6 shows the rotation mount rotated toward a stored orientation where the first end of the lock member (which in one form is a T-shape member) is positioned adjacent to the open region of the lock port of the rotation mount.
Figure 7:
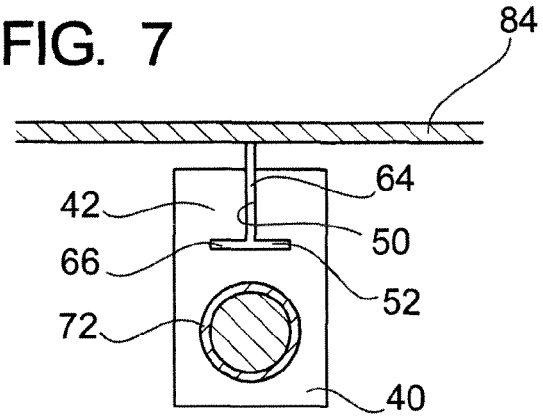
FIG. 7 shows a view taken along line 7-7 of FIG. 6 showing the bottom surface of the rotation mount.

Therefore, the rotation mount 40 is adapted to rotate about a lateral axis with respect to the base mount 22. As shown in FIG. 7, the locking portion 42 comprises a lock surface 50 that is substantially a similar cross-sectional shape in one form as the access port 32 of the base member 22 and the lock surface 50 further defines a lock port 52 which is similar to the access port 32 of the base member 22. The lock port 52 is of a cross-sectional area to allow the lock member 26 to pass therethrough. It should be noted that the lock member 26 comprises the lateral components 56 and 58 which comprise various vertical surfaces there below and above. Of course, it should be reiterated that the lateral components 56 and 58 are shown where two components are utilized in a T-like assembly; however, of course in a broader scope only one lateral component could be utilized or other types of lateral extensions having some sort of a lateral surface area to engage the channel portion of the base member as well as the lock port of the pivot mount to hold these components in a vertically orientated matter. The surfaces 56 and 58 are adapted to engage the corresponding surfaces in the lower lateral regions 60 and 62 of the access port 32 as well as the corresponding regions 64 and 66 of the lock port 52. As shown in FIG. 4, it should be noted that the base member as well as the lock member each have first and second lateral portions 100 and 102 which are configured to receive the first and second lateral components 56 and 58 of the lock member 26 when the pivot mount is in a stored orientation such as at that as shown in FIGS. 5-8. Therefore, the surfaces 56 and 58 provide a locking-like action, but when the lock member is fully extended to the access port and the lock port of the base member 22 and the rotational mount 40, the ladder assembly 24 is in a substantially upright position as shown in FIG. 1.

Figure 2:
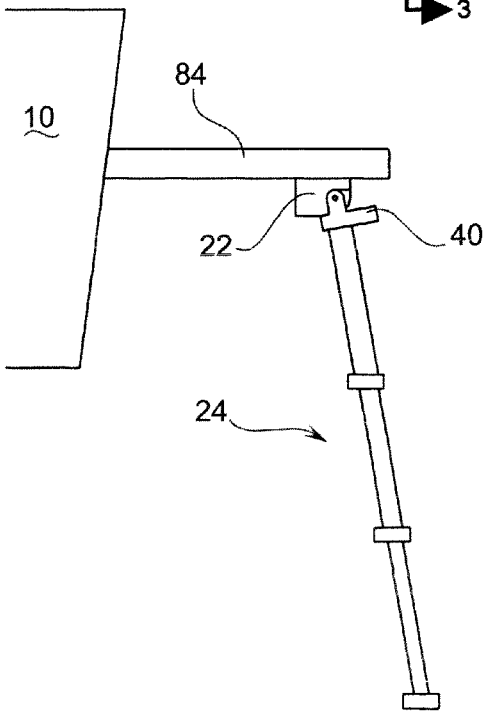
FIG. 2 shows a side orientation of the ladder attachment in an extended and operational orientation attached to for example a transom of a water vessel.

Referring now to the right-hand portion of FIG. 2, there is shown the extendable ladder portion 70. As shown in FIG. 3 there is shown the extendable ladder portion 70 in detail in an extended orientation where the components 72, 74, and 76 are extended outwardly about the ladder axis 78 schematically shown in FIG. 3. In general, the ladder axis is a reference access to define the approximate center access of the extendable ladder portion 70. Each ladder section 72, 74, and 76 has a laterally extending support mount that is adapted to have weight be depressed thereon for climbing up the ladder to get out of the water on to the water vessel.

As shown in for example FIG. 12, the ladder assembly is comprised of a plurality of ladder sections where the first ladder section 72 in one form is of the greatest diameter and the second ladder section 74 telescopically extends there within. FIG. 12 further shows the first and second ladder section 72 and 74 in an extended orientation, whereas in FIG. 5, it can be appreciated that the ladder is shown in a stored orientation. Of course, in the broader scope any number of ladder extension members can be utilized. In one form, three ladder extension members are shown, but in some cases there may be only one ladder extension where the base region 22 and the lock member 26 are sufficient to have an embodiment where the ladder attachment 20 has a stored orientation and an operational orientation which is sufficient to transfer to and from the water or otherwise lower and raise oneself from a deck portion, in other uses of the ladder attachment 20. In one form, the ladder sections are comprised of a central post indicated at 73 and 75.

Figure 8:
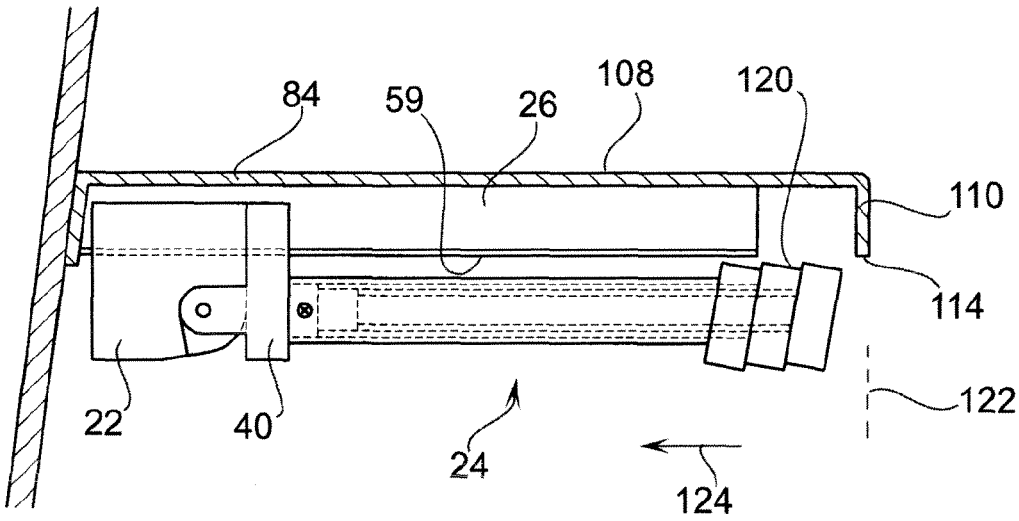
FIG. 8 shows the lock member extending there the lock port of the rotation mount orientating the assembly in a stored orientation.

Now referring to FIG. 8, it can be seen how the base portion 22 is repositioned rearwardly with respect to the lock member 26 whereby the forward portion 27 of the lock member is not in engagement with the lock port 52 of the rotation mount 40. Therefore, in this configuration the ladder assembly 24 is allowed to freely rotate about the pivot attachment region 44 downwardly. In this employed or operational configuration, the ladder can be climbed upon.

Figure 9:
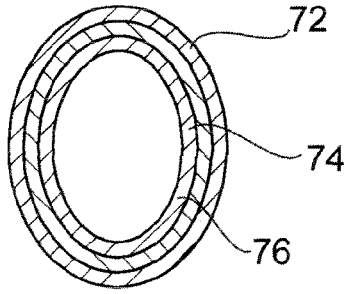
FIG. 9 shows a cross-sectional view of the telescopic nature of the ladder component members which in one form are attached by a center attachment pole.
Figure 10:
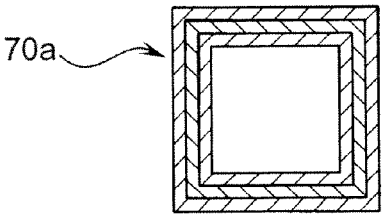
FIGS. 10 and 11 show various other possible configurations by way of example to illustrate other cross sections which are noncircular to prevent rotation of the ladder components with respect to one another.
Figure 11:
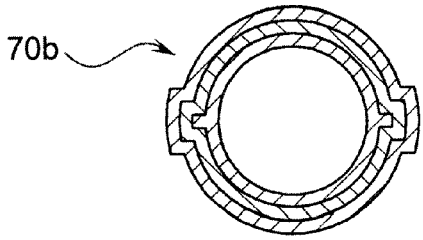

Referring to FIG. 9, there is shown an end view taken substantially along the ladder axis 78. In this figure it can be seen that the various ladder components 72, 74, and 76 have a non-oval cross-sectional area to prevent rotation of non-circular cross-sectional areas to prevent rotation of the components. Of course, in one form this non-circular cross-sectional area can be an oval-like member which is one form of manufacturing the telescopically extendable ladder portion 70. However, any variety of types of cross-sectional areas, shown in FIGS. 10 and 11, are shown for exemplary purposes. In one form, the outer surface of the upper portion of say, for example, the member 74 as shown in FIG. 3, can be the slightly larger diameter with the respective lower region. In other words, the area indicated at 80 may be of a slightly larger diameter than the lower area indicated at 82. In this form, when the ladder is in the extended position, this slight engagement allows for a slight locking action between the outer surface indicated at 80 and the inward surface of the section 72 indicated at 84. Of course various modifications can be included without departing from the spirit and scope of the disclosure.

As shown in FIG. 5, the perimeter region 106 of the platform 108 has a flange portion 110 with an inner surface 112 and a lower surface 114. The first end 104 of the lock member 26 is positioned in a manner so the upper portion 101 of the pivot mount can freely rotate within the chamber area defined at 114 to a stored orientation as shown in FIG. 6 when the base member 22 is slideably positioned adjacent to the first end region 104 as is shown in FIGS. 5 and 6.

Now referring to FIG. 8, in one preferred form, the ladder assembly 24 is configured to fit underneath the platform 108 where the front surfaces 120 of the step members for example pass under the lower surface 114 of the flange member 110. Further, in one form the assembly further passes under the lower surface 59 of the lock member 26. It should be noted in FIG. 8, the ladder assembly in one form fits entirely within toward the water vessel the plane 122 defined by the flange portion 110. As the ladder assembly 24 is repositioned (along with the pivot mount 40 and the base member 22) in the first longitudinal direction as indicated by the vector 124, the entire assembly is substantially concealed.

Still referring to FIG. 8, there is shown a partial sectional view where it can be shown that the lock member 26 is rigidly attached to the bottom portion of the transom or transom-like extension portion of the water vessel indicated at 84. The base region 22 is attached to the lock member and further, the locking portion 42 is in the upright retained locked orientation. It can be appreciated that the device can be repositioned in the direction as indicated by the vector 88 whereby the lock portion 42 disengages from the locking member 26 to freely rotate downwardly to an operable position.

Referring back to FIG. 1, it can be appreciated that each of the ladder components 72, 74 and 76 have a corresponding step member 140, 142 and 146. Each of these members have an upper surface 148, 150 and 152. Of course, these step members are configured to support weight thereon to transfer people to and from the surrounding environment which in one form is a body of water.

Of course, it can be appreciated that the pivot mount in the base member each have the lock ports and the central channel respectively which is a substantially similar cross-sectional shape as the lock member in its cross-sectional orientation as, for example, shown in FIG. 4. In one preferred form, the shape is a T-like member but, of course, other forms could be utilized. By having a substantially similar cross-sectional shape, of course there is allowed for a slight tolerance and perhaps a slightly larger opening than that of the lock member to allow the unit to be slideably positioned thereon; however, in one form having a slight interference fit is desirable so the base member does not reposition toward the first end 104, as shown in FIG. 5, when the water vessel is in motion. A slight interference fit having, for example, a frictional engagement member such as a set screw-like device with, for example, a Mylar tip can provide enough sliding resistance to hold the unit in place. It can further be appreciated that in a stored orientation the ladder assembly 24 is substantially horizontal; of course, being substantially horizontal means it could have a slight angle about its center axis 78 with respect to the horizontal plane. As shown in FIG. 3, the range of motion of the lock member in this form is substantially the entire length of the lock member in the horizontal direction. Of course, a lock member could have a shorter prescribed length than the length of the entire unitary structure.

It should further be noted that the width of the central member of the ladder assembly and the mount region comprising the pivot mount, base member and the lock member are substantially narrow in one form in the lateral direction. For example the mean width of these elements can be ⅓ of the width of the ladder members. Of course in other forms the pivot mount and the base member can be connected to a ladder assembly with vertical members on the out lateral region of the ladder.

As shown in FIGS. 13-16, there is another embodiment where the assembly 220 is shown where the base member 222 is shown which would be affixed to a structure such as a transom of a boat and a ladder assembly 224. As shown in a left-hand portion of FIG. 13, there is a ladder assembly 224 which is approximately 15° from vertical (for example plus or −3°) in the upper right hand portion of FIG. 13. The user's body weight when climbing the ladder will lean inward toward the attachment and the angle further provides the user's body weight to be centered over the steps so the user does not have to hang on as much to the ladder.

Figure 16:
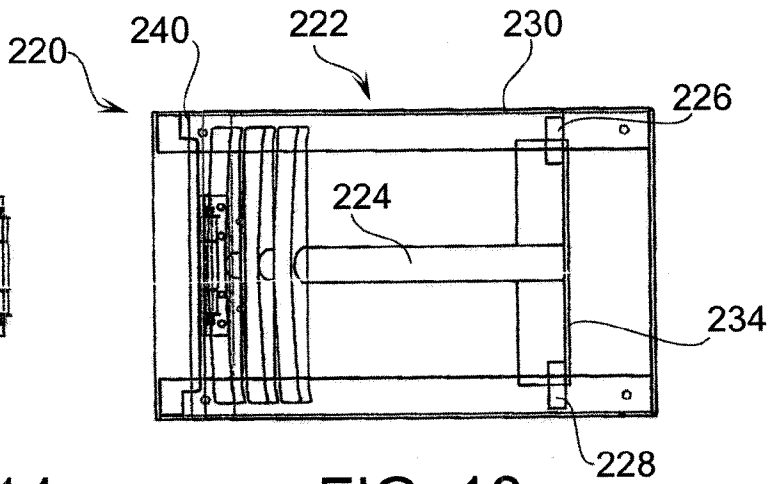
FIG. 16 shows a top view of the ladder mechanism in the stored orientation.
Figure 14:
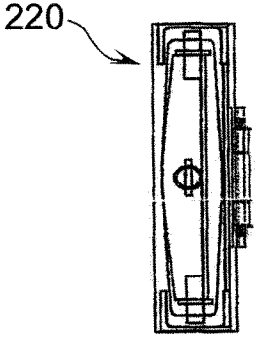
FIG. 14 shows an end view of the ladder mechanism in a stored orientation.
Figure 13:
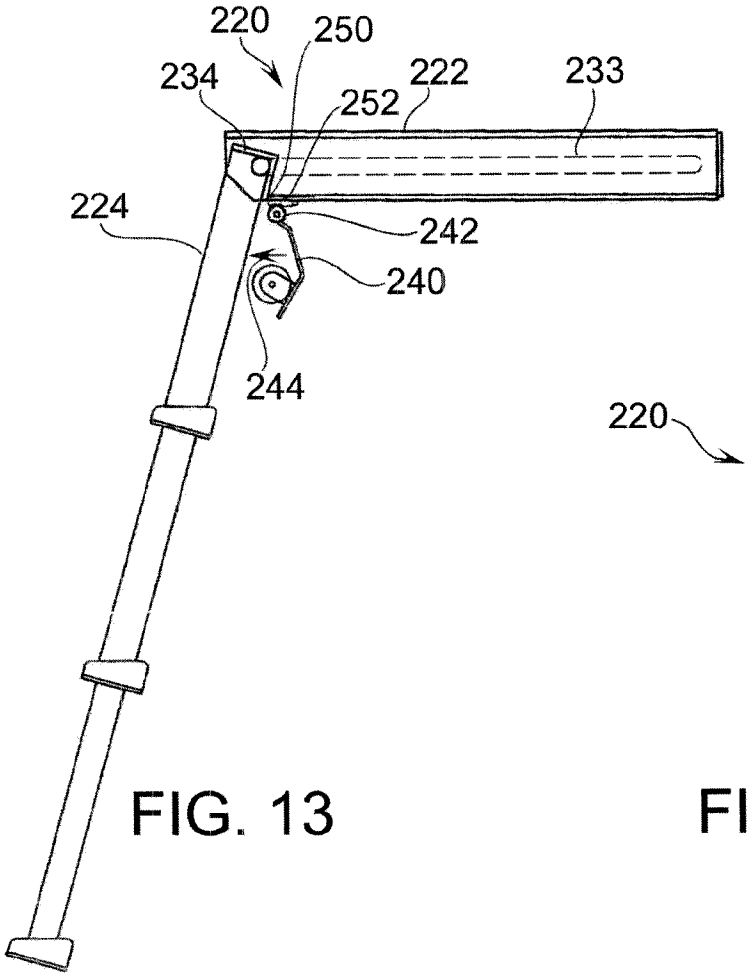
FIG. 13 shows a side view of another embodiment of the ladder mechanism in an extended orientation.

As shown in FIG. 16, there are laterally extending pins 226 and 228 which engage within a block portion 230 of the base member 222 and rides therein. The two as shown in FIG. 13 within the block 230 at 233 by the hatched line. The longitudinal slot within the block portion 230 which accepts the pins 226 which are attached to the center mass cross-member 234. It should be noted that the blocks have two bolts each which ride into a slot which runs longitudinally in the channel 230. The blocks generally indicated at 230 have a stop region indicated at 240 which prevents the pins 226 and 228 from being fully withdrawn.

As shown in FIG. 13, there is a door mechanism 240 that is attached at the pivot location 242 and in one form has a spring member therein which places a torque indicated by the torque arrow 244 toward the ladder assembly 224. Now referring to FIG. 15, it can be appreciated how the door mechanism 240 automatically closes to conceal the ladder assembly 224 therein a central chamber region 246.

FIG. 16 shows a top view of the ladder assembly to 220 in a stored orientation. Referring now back to FIG. 13, it can be appreciated how the cross-member 234 which in one form is an angle iron-like structure and operates as a pivot mount and has a lower region 250 which engages the outer lip 252 of the lower portion of the base member 222. In this form, this engagement provides the prescribed angle of the ladder assembly 224 as described above.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A ladder attachment configured to attach to a perimeter region of a water vessel, the ladder attachment comprising:

a) lock member fixedly attached to the water vessel comprising a lateral component extending at least in part in a lateral direction, b) a base member with at least one laterally extending portion configured to receive and be slideably but not rotatably attached to the lock member, the base member further having an attachment region operatively configured to couple to a ladder assembly, c) a rotation mount rotatably and not slideably attached to the attachment region of the base member, the rotation mount having an operational orientation and stored orientation with respect to the base member, d) the ladder attachment having a surface defining a lock port, the lock port being in substantial alignment with a channel portion of the base member when the rotation mount is in the stored orientation and configured to maintain the rotation mount in the stored orientation, e) the ladder assembly having a first ladder section fixedly and rigidly attached to the rotation mount, a second ladder section is telescopically attached to the first ladder extension to have an extended orientation and a retracted orientation and where the ladder assembly is substantially horizontal when the rotation mount is in the stored orientation, and f) the ladder assembly comprises a pivot stop operably configured to prohibit the rotation of the rotation mount relative to the base member short of a fully vertical position when the rotation mount is in the operational orientation.

2. The ladder attachment as recited in claim 1 where the attachment region of the base member is a pivot attachment with a pivot pin extending therethrough.

3. The ladder attachment as recited in claim 1 where the first and second ladder sections comprise a central telescoping post.

4. The ladder attachment as recited in claim 3 where the central post of the first and second ladder sections have a cross sectional area which is noncircular to prevent rotation of the second ladder section with respect to the first ladder section.

5. The ladder attachment as recited in claim 4 where the cross sectional area of the central post of the second ladder section is substantially oval.

6. The ladder attachment as recited in claim 4 where the cross-sectional area of the central post of the second ladder section is substantially rectangular.

7. The ladder attachment as recited in claim 1 where the lateral component of the lock member comprises a first lateral component and a second lateral component is provided where the central channel of the base member and the surface defining the lock port of the rotation mount each have first and second lateral portions orientated to have the first and second lateral components extend therethrough when the rotation mount is in the stored orientation.

8. The ladder attachment as recited in claim 7 where the lock member has a first end region which is positioned adjacent to a swim platform of the water vessel where the distance between an inner surface of the swim platform and the first end region of the lock member is sufficient to allow an upper portion of the rotation mount to freely rotate therein when the base member is slideably positioned toward and engaging the first end region of the lock member.

9. The ladder attachment as recited in claim 8 where the ladder assembly in a stored orientation is configured to pass below a lower surface of the swim platform when the ladder attachment is in a stored orientation and slideably positioned a first longitudinal direction along the lock member.

10. The ladder attachment as recited in claim 9 where the ladder assembly fits entirely under the swim platform when in a stored orientation.

11. The ladder attachment as recited in claim 1 wherein the locking member is substantially the same length as the first ladder section.

12. The ladder attachment as recited in claim 1 wherein the shape of the central channel of the base member in cross section is substantially the same.

13. A method of repositioning a ladder attachment from an operational orientation to a stored orientation;

a) providing a lock member rigidly attached to a structure to be climbed upon, b) slideably positioning a base member to the lock member where the lock member's cross sectional area is substantially constant to allow the base member to be slideably attached thereto for a prescribed range of travel, c) rotatably and not slideably attaching a rotation mount to the lock member providing a surface defining a lock port, a ladder assembly being rigidly attached to the rotation mount, d) pivoting the rotation mount upwardly so the lock port coincides in location along a plane defined by cross-sectional area of the lock member and repositioning the base member and the rotation mount with respect to the lock member so the lock member extends within the lock port of the rotation mount thereby fixing the rotation mount in a vertically raised orientation, e) having the ladder assembly be retracted to shorten the overall length of the ladder assembly.

14. The method as recited in claim 13 where the base member and the rotation mount are positioned such that a ladder axis is substantially aligned perpendicular to a transom of the water vessel underneath a swim platform.

15. The method as recited in claim 14 where the ladder attachment is entirely positioned beneath the swim platform when in a stored orientation.

16. The method as recited in claim 13 where the ladder assembly is comprised of a plurality of ladder sections each having a center post telescopically attached where a ladder support member extends parallel to the ladder axis on the lower portion of each ladder section.

17. The method as recited in claim 13 wherein the locking member is substantially in alignment with the ladder when the ladder is in the stored orientation.

18. A ladder assembly attached to a water vessel, the ladder assembly comprising:

a) a base member and a rotation mount rotatably and not slideably attached to the base member, b) a lock member fixedly attached to the water vessel, the lock member having a laterally extending surface, c) an extendable ladder attached to the rotation mount having a support surface moveably repositioned along the lock member, where the rotation mount is in a stored orientation with the extendable ladder positioned in a substantially horizontal orientation and the surface of the rotation mount is engaged with the lock member to maintain the ladder in the substantially horizontal orientation, d) the extendable ladder being comprised of a plurality of ladder sections each comprising a singular central tube, wherein the ladder sections telescopically extend within one another in a single array of telescopically extending members and the plurality of ladder sections do not rotate with respect to one another about a ladder axis positioned at a substantial center of the extendable ladder and the ladder sections will not disengage from one another when in an extended orientation, and e) wherein the ladder assembly comprises a pivot stop operably configured to prohibit the rotation of the extendable ladder relative to the base member short of a fully vertical position when the rotation mount is in an operational orientation, wherein the base member is slideably attached to a lock member and the rotation mount is attached to an attachment portion of the base member, the rotation mount having an operational orientation and stored orientation with respect to the base member, the rotation mount having a surface defining a lock port, the lock port being in substantial alignment with a channel portion of the base member when the rotation mount is in the stored orientation and further in the stored orientation the lock port is operatively configured to have a portion of the lock member extend there through to maintain the rotation mount in the stored orientation.

19. The ladder assembly as recited in 18 where the extendable ladder is at least 12 degrees from vertical when in an operational orientation.

20. The ladder assembly as recited in 18 where the rotation mount is pinned to the base member with a laterally extending pin member.

* * * * *